US006670754B1

(12) United States Patent
Murai et al.

(10) Patent No.: US 6,670,754 B1
(45) Date of Patent: Dec. 30, 2003

(54) GAS DISCHARGE DISPLAY AND METHOD FOR PRODUCING THE SAME

(75) Inventors: Ryuichi Murai, Toyonaka (JP); Yuusuke Takada, Katano (JP); Akira Shiokawa, Osaka (JP); Katutoshi Shindo, Higashiosaka (JP); Hidetaka Higashino, Kyoto-fu (JP); Nobuaki Nagao, Katano (JP); Toru Ando, Osaka (JP); Masaki Nishimura, Takatuki (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 324 days.

(21) Appl. No.: 09/744,378

(22) PCT Filed: Jun. 2, 2000

(86) PCT No.: PCT/JP00/03577

§ 371 (c)(1),
(2), (4) Date: Jan. 23, 2001

(87) PCT Pub. No.: WO00/75951

PCT Pub. Date: Dec. 14, 2000

(30) Foreign Application Priority Data

Jun. 4, 1999 (JP) ..... 11/158220

(51) Int. Cl.[7] ..... H01J 17/49
(52) U.S. Cl. ..... 313/582
(58) Field of Search ..... 313/292, 313, 313/581, 582, 584, 585, 586, 587

(56) References Cited

U.S. PATENT DOCUMENTS 5,587,624 A 12/1996 Komaki
5,742,122 A 4/1998 Amemiya et al.
6,400,081 B1 * 6/2002 Matsumoto et al. ..... 313/582
6,433,489 B1 * 8/2002 Tanaka et al. ..... 315/169.4
6,522,075 B2 * 2/2003 Koshio et al. ..... 313/586
6,545,412 B1 * 4/2003 Jang ..... 313/587
2003/0080682 A1 * 5/2003 Nagano ..... 313/582
2003/0146700 A1 * 8/2003 Amatsuchi ..... 313/582

FOREIGN PATENT DOCUMENTS

JP 07-138601 5/1995
JP 07-2888087 10/1995
JP 08-250029 9/1996
JP 10-321142 12/1998
JP 10-334811 12/1998
JP 11-109888 4/1999

* cited by examiner

*Primary Examiner*—Eric S. McCall

(57) ABSTRACT

A gas discharge display apparatus, in which a plurality of cells filled with a discharge gas are arranged in a matrix pattern in a space between first and second substrates placed in opposition to each other, and at least one pair of display electrodes are arranged on a surface of the first substrate facing the second substrate so as to span the plurality of cells. Here, each pair of display electrodes includes two extension parts that extend lengthwise along the matrix. A plurality of inner projections are electrically connected to each extension part, and protrude toward the other extension part. At least two connectors are arranged, with a fixed interval therebetween, between the two extension parts, each connector electrically connecting at least two inner projections provided for a same extension part.

43 Claims, 13 Drawing Sheets

(a)

(b)

GAS DISCHARGE DISPLAY AND METHOD FOR PRODUCING THE SAME

TECHNICAL FIELD

The present invention relates to a gas discharge display apparatus having a gas discharge panel, such as a plasma display panel, and a manufacturing method for the same.

BACKGROUND ART

Large screen display devices with high picture quality, such as that produced by high definition television (HDTV), have recently become the focus of much expectation. As a result, research and development of display devices such as cathode ray tubes (CRTs), liquid crystal displays (LCDs), and plasma display panels (PDPs) is taking place. These various types of display devices each have the following characteristics.

CRTs have excellent resolution and picture quality, and are widely used in conventional televisions and the like. The large increases in depth and weight required to produce a large screen CRT, however, are problematic, and solving this difficulty is crucial for the development of such CRTs. Due to this problem, it is believed to be difficult to produce a CRT with a large screen of more than 40 inches.

LCDS, on the other hand, use less electricity than CRTs, and are extremely light and slim. Nowadays, LCDs are being increasingly used as computer monitors. However, typical LCD, which uses a thin film transistor (TFT) screen or similar, has an extremely intricate structure, and so manufacture of such a device requires a plurality of complicated processes. These processes become increasingly complex as screen size increases, with the result that manufacturing yield decreases as screen size grows larger. This means that it is currently considered difficult to manufacture an LCD with a screen of more than 30 inches.

In contrast to CRTs and LCDs, PDPs are gas discharge panel display apparatuses that have the advantage of being able to realize a lightweight display with a large screen. Therefore, in the current search for the next generation of displays, research and development of large screen PDPs is being pursued particularly aggressively, and products with screens of more than 60 inches are being developed.

In a basic PDP structure, a glass substrate, on which a plurality of pairs of display electrodes and a plurality of barrier ribs are arranged in a stripe formation, is placed in opposition to another glass substrate. Phosphors in each of the three colors red, green and blue are applied hermetically to the spaces between the barrier ribs. The two glass substrates are then sealed together so as to be airtight, and a discharge gas enclosed in the discharge spaces between the barrier ribs and the two glass substrates. Discharge from the plurality of pairs of display electrodes causes the discharge gas to generate ultraviolet (UV) light, and this in turn causes the phosphors to emit light. Here, FIG. 13A is a diagonal view of a pair of conventional PDP electrodes 22 and 23 arranged on top of a front glass substrate 21, and FIG. 13B is an aerial view of the pair of electrodes 22 and 23 looking down in a direction z. The electrodes 22 and 23 shown in the drawings are formed from strip-shaped transparent electrodes 220 and 230, on which metal bus lines (bus electrodes) 221 and 231 are overlaid. A numerical reference 340 indicates cells for image display divided by neighboring barrier ribs 30, so that, for example, cells 340 having phosphor layers in the colors red, green and blue are arranged in parallel with the x direction, forming pixels for achieving a color display.

PDPs such as this one can be divided into two types, direct current (DC) and alternating current (AC), according to the driving method used. AC PDPs are thought to be more suitable for producing a large screen device, and thus are the most common type of PDP.

However, current demand is for electronic products that limit consumption of electricity to as low a level as possible. In this climate, the need for PDPs that can be driven using a small amount of electricity is growing. In particular, the current trend toward development of large-screened and high-resolution PDPs has led to an increase in the electrical consumption of such PDPs, and so there is an increasing demand for energy-saving techniques. It is hoped that such techniques will reduce the electrical consumption of PDPs.

However, merely carrying out strategies for reducing the electrical consumption of a PDP causes the scale of discharge generated between the plurality of pairs of display electrodes to be reduced, and satisfactory light emission becomes unachievable. As a result, it is necessary to maintain satisfactory display quality (in other words satisfactory luminous efficiency) while limiting electrical consumption. If insufficient light is emitted, the display quality of the PDP will be reduced, so merely decreasing the electrical consumption of the PDP cannot be said to be a valid strategy for increasing luminous efficiency.

Research is being conducted into a method for improving luminous efficiency by, for example, raising the efficiency with which phosphors convert ultraviolet light into visible light. However, at this point in time no noticeable improvements have been observed by using this method, and there is still room for further research to be conducted.

The above problem is not confined to a gas discharge panel such as a PDP (that emits light by generating a discharge within a glass container filled with discharge gas), and also exists, for example, in other gas discharge display apparatuses that provide a gas discharge device other than a PDP.

Currently, it is thought to be extremely difficult to preserve the appropriate luminous efficiency in this kind of gas discharge display apparatus.

DISCLOSURE OF THE INVENTION

The present invention is designed to overcome the above problems, and has as its object the provision of a gas discharge display apparatus capable of preserving appropriate luminous efficiency, and by this means achieving a lower level of electrical consumption than is conventionally possible, while preserving the scale of discharge required to achieve satisfactory display quality, and of a manufacturing method for the same.

The above object is realized by a gas discharge display panel in which a plurality of cells filled with a discharge gas are arranged in a matrix pattern in a space between first and second substrates placed in opposition to each other. At least one pair of display electrodes are arranged on a surface of the first substrate facing the second substrate so as to span the plurality of cells. Each pair of display electrodes includes two extension parts that extend lengthwise along the matrix, a plurality of inner projections electrically connected to each extension part, and protruding toward the other extension part, and at least two connectors arranged, keeping a fixed interval therebetween, between the two extension parts. Each connector electrically connects at least two inner projections provided for a same extension part.

In the present invention, display electrodes are formed by combining inner projections and connectors, so the discharge generated in the gap between a pair of display electrodes is gradually expanded by the inner projections and the connectors connected to the inner projections. In particular, since the connectors and inner projections are electrically connected, satisfactory expansion of discharge can be achieved along the display electrodes.

Furthermore, a plurality of apertures are formed between the extension parts and the plurality of connectors. Naturally a charge is not accumulated in these apertures, and so an electric charge accumulated on the display electrodes is reduced to less than in the prior art when discharge is started by driving the gas discharge display apparatus. Once discharge has started, it also expands by diffusing to the apertures, and so a satisfactory level of discharge can be achieved in spite of the presence of the apertures.

Such characteristics enable the gas discharge display apparatus of the present invention to reduce the charge accumulated on the display electrodes, and restrict power consumption, as well as maintaining a display quality that is at least equivalent to that of a conventional device. In other words, the present invention effectively reduces the surface area of the display electrodes in the display unit (electric capacity), reducing excess power consumption, and realizing a gas discharge display apparatus with superior luminous efficiency.

References such as Japanese Laid Open Patent H8-250029, and U.S. Pat. No. 5,587,624 disclose an example of a technique for providing a plurality of projections for the display electrodes, thereby improving luminous efficiency and the like.

However, these references do not disclose a technique like the one described in the present invention for providing connectors to electrically connect the at least two inner projections, and since projections are formed independently, alignment is difficult to achieve. The present invention, provides the display electrodes with connectors, achieving a superior effect by avoiding both the large increases in manufacturing costs caused by variations in accuracy during manufacturing, and deterioration in image uniformity.

An actual example of the gas discharge display apparatus of the present invention may be a PDP or similar device. PDPs with larger screens are currently being developed, and this leads to increases in power consumption. Consequently, the present invention is particularly effective when applied to a PDP.

The present invention may arrange a plurality of connectors on each extension part.

Furthermore, the inner projections and the connectors may be manufactured of a transparent electrode material, and the extension parts of a metal material. Here, the extension parts are bus lines. Since the transparent electrode material has a lower electric resistance than the metal material, if this construction is applied in the present invention, power consumption is likely to be further reduced.

Furthermore, the present invention, outer projections may extend from a side of a bus line in an opposite direction to inner projections. When such a technique is used, in addition to the above effects, discharge expands from the bus line outward, and superior luminous efficiency can be achieved.

In addition, when a layer is formed so as to cover the at least one pair of display electrodes, areas of the layer corresponding to a minimum discharge gap between a pair of display electrodes may be formed of magnesium oxide, and other parts of the layer from a material with a lower electron emission yield than magnesium oxide (for example aluminum). This enables discharge to be generated more easily in an initial discharge period when the gas discharge display apparatus is driven.

A BRIEF EXPLANATION OF THE DRAWINGS

FIG. 12A is a diagonal view of the entire gas discharge device;

FIG. 12B shows a structure of a discharge electrode in a gas discharge device;

FIG. 13A is a partial diagonal view showing conventional display electrodes; and FIG. 13B is an aerial view showing conventional display electrodes.

PREFERRED EMBODIMENTS OF THE INVENTION

1. Structure of Gas Display Apparatus

1-1. First Embodiment

Figure 1:
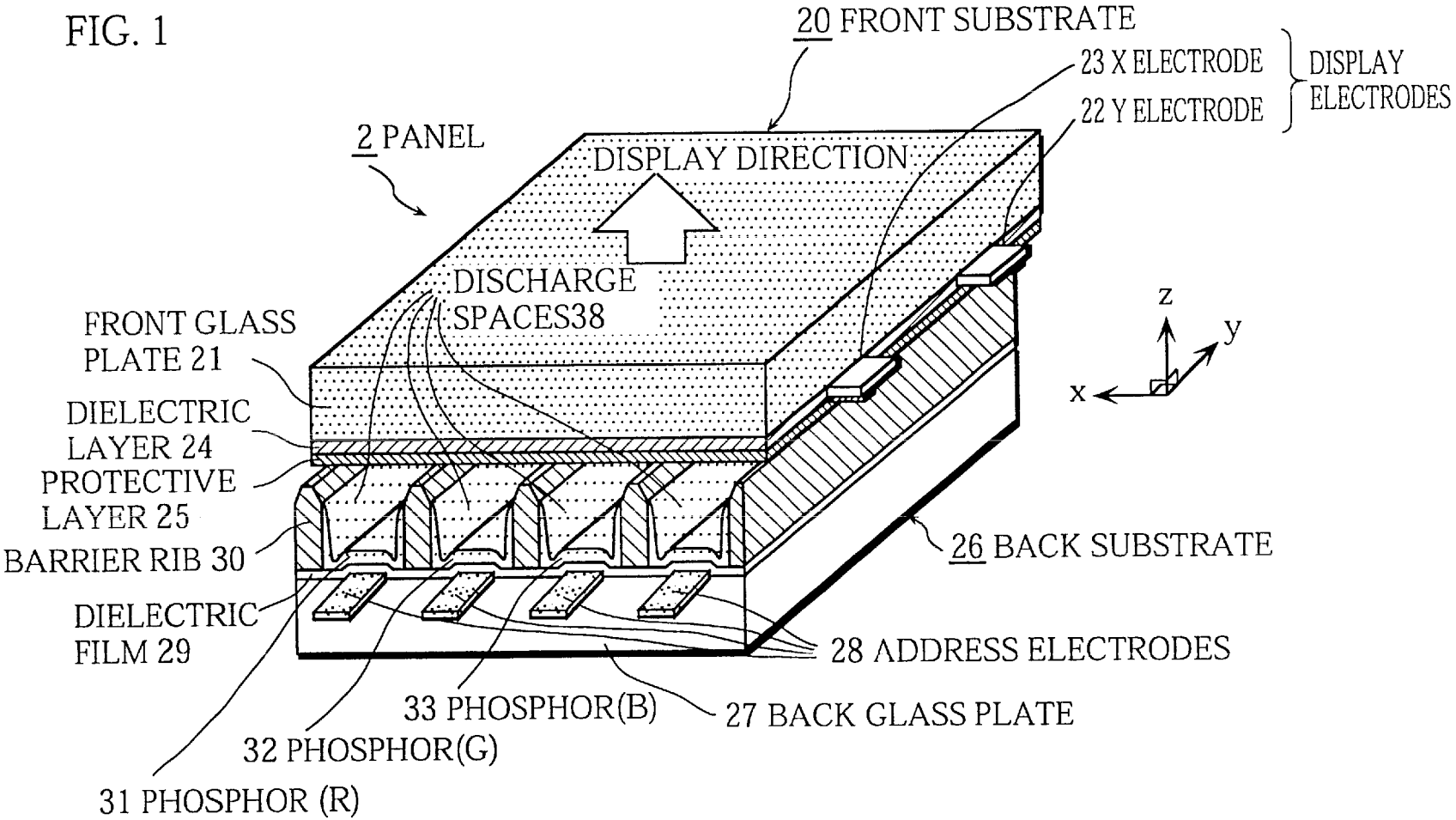
FIG. 1 is a diagonal view of part of a PDP in a first embodiment of the invention.

FIG. 1 is a diagonal view in cross-section showing part of a basic structure for a panel 2, that is for a AC surface discharge PDP that is one example of a gas discharge display apparatus in a first embodiment. In the drawing, an z direction corresponds to the depth of the PDP, and an xy plane to a flat surface parallel to the panel surface of the PDP. The directions x, y, and z are identical in all of the FIGS. 1 to 13 explained hereafter. The structure of the PDP can be broadly divided into the panel 2, and a panel driver 1 (explained hereafter).

The panel 2 is formed from a front substrate 20 and a back substrate 26, arranged with their respective main surfaces in opposition.

A pair of display electrodes 22 and 23 (X electrode 22, and Y electrode 23) are formed parallel with the x direction on one surface of a front glass plate 21 that forms the base for the front substrate 20. Surface discharge is generated between the pair of electrodes 22, and 23. The detailed structure of the display electrodes 22, and 23 is explained later in this description.

The entire surface of the front glass plate 21, on which the display electrodes 22 and 23 have been arranged, is coated with a dielectric layer 24. Then, a protective layer 25 is coated on top of the dielectric layer 24.

A plurality of address electrodes 28 are arranged at fixed intervals in a stripe formation parallel with the y direction, on one surface of a back glass substrate 27 that forms the base for the back substrate 26. Then the entire surface of the back glass substrate 27 is coated with a dielectric layer 29 so as to embed the address electrodes 28. Barrier ribs 30 are arranged on top of the dielectric layer 29 in the gaps between neighboring address electrodes 38. Then phosphor layers 31, 32, and 33, which correspond respectively to the three colors red (R), green (G), and blue (B), are formed in turn on the side walls of neighboring barrier ribs 30 and the surface of the dielectric layer 29 therebetween. These R, G, and B phosphor layers are arranged in order, parallel with the x direction, enabling a color display to be formed.

A front substrate 20 and back substrate 26 having the above structure are placed in opposition so that the address electrodes 28 are orthogonal to the display electrodes 22 and 23. Then, the perimeters of the front and back substrates 20 and 26 are brought into contact and sealed. Following this, a discharge gas (filler gas) formed of one or more inert gases such as He, Xe, and Ne, is introduced into the space between the front and back substrates 20 and 26 at a certain pressure (conventionally this is in a range of around $4\times10^4$ to $8\times10^4$ Pa). Following this, the gaps between neighboring barrier ribs 30 become discharge spaces 38, and an area in which a pair of neighboring electrodes 22 and 23 and an address electrode 28 intersect orthogonally with a discharge space 38 therebetween, corresponds to an image display cell 340 (shown in FIG. 2 onward). Then, when the PDP is driven by the panel driver 1, vacuum ultraviolet light (a resonance line having central wavelengths of 147 nm and 173 nm) is generated from discharge produced between the address electrode 28, and one of the display electrodes 22 and 23 (in this embodiment, the X electrode 22), and between the pair of display electrodes 22 and 23, and phosphor layers 31 to 33 emit light to display an image. Note that conventionally the X electrode 22 is referred to as a scan electrode, and the Y electrode 23 as a sustain electrode.

Note that the inside of discharge spaces 38 is exhausted via a tip tube (not shown) attached to the back substrate 26, and then discharge gas is introduced at a certain pressure (in the PDP of the present invention $2.6\times10^5$ Pa). When the pressure of the discharge gas is higher than atmospheric pressure, the front and back substrates 20 and 26 should preferably be connected via the tops of the barrier ribs 30.

Figure 2:
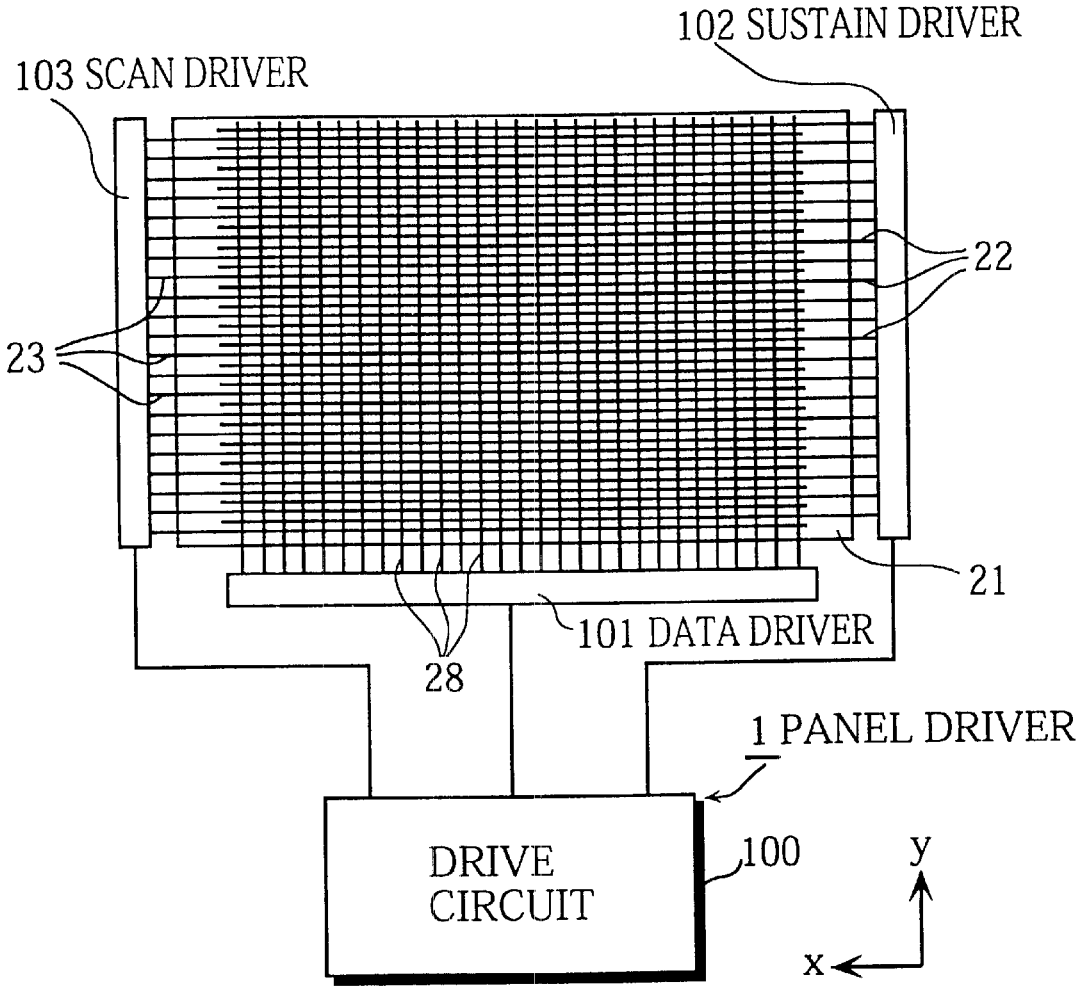
FIG. 2 is an outline drawing of a PDP panel driver, display electrodes and the like in the first embodiment.

Here, FIG. 2 is an outline drawing of the front substrate 21 on which the display electrodes 22 and 23 have been arranged, and the panel driver 1 that is connected to the display electrodes 22 and 23 and the address electrodes 28.

The panel driver 1 shown in the drawing has a structure well-known in the art, and includes, for example, a data driver 101 connected to address electrodes 28, a sustain driver 102 connected to Y electrodes 22, a scan driver 103 connected to X electrodes 23, and a drive circuit 100 that controls the drivers 101 to 103.

The drivers 101 to 103 control the passage of current respectively to connected electrodes 22, 23, 28 and the like, the drive circuit 100 controls the operations of the drivers 101 to 103, and enables an image to be displayed accurately.

The drive circuit 100 has an internal memory that temporarily stores image data output from outside of the PDP, and a plurality of internalized circuits that successively read pieces of the stored image data and perform image processing such as gamma correction.

Figure 3:
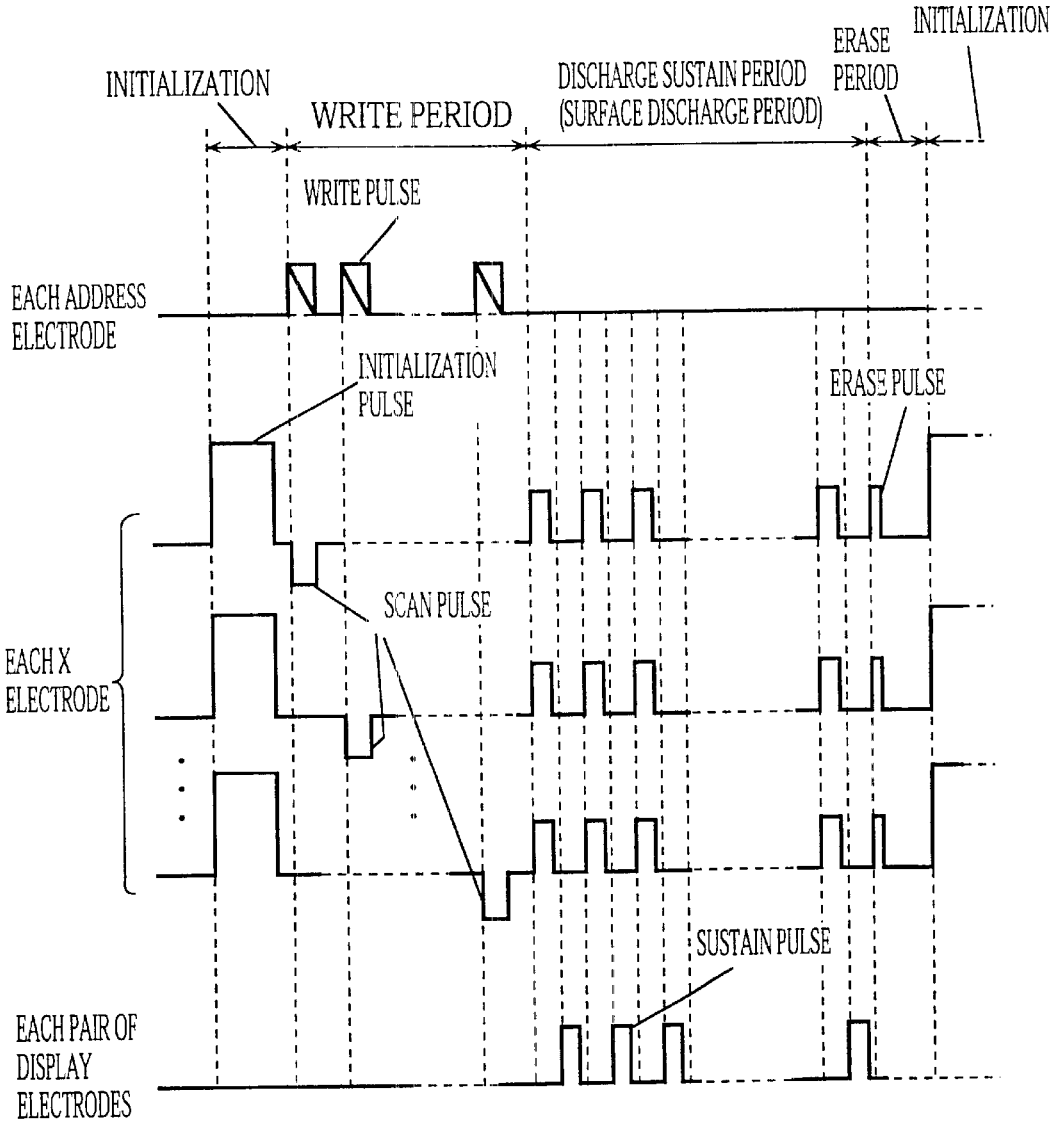
FIG. 3 shows a drive process performed by the panel driver in the first embodiment.

Next, the general driving procedure performed by the panel driver 1, including the above components 100 to 104, to drive the PDP is explained with reference to FIG. 3.

First, an initializing pulse is applied to the X electrodes 22 by the scan driver 103 in the panel driver 1, thereby initializing a charge (wall charge) inside the cells 340.

Next, the panel driver 1 uses the scan driver 103 and the data driver 101 respectively to simultaneously apply (1) a scan pulse to an X electrode 22 that is first from the top of the flat surface of the panel 1, and (2) a write pulse to an address electrode 28 corresponding to a display cell 340, generating a write discharge, and accumulating a wall charge on the surface of the dielectric layer 24.

Next, the panel driver 1 simultaneously applies a scan pulse to the second X electrode 22, and a write pulse to an address electrode corresponding to a display cell 340, generating a write discharge and accumulating a wall charge on the surface of the dielectric layer 24.

The panel driver 1 applies successive scan pulses to accumulate wall charges on parts of the surface of the dielectric layer 24 corresponding to each display cell 340 in turn, thereby writing a one-screen latent image.

Next, in order to generate a sustain discharge (surface discharge), the panel driver 1 grounds the address electrodes 28, and uses the scan driver 103 and the sustain driver 102 to apply alternating sustain pulses between a pair of display electrodes 22 and 23. This enables a discharge to be generated when the potential of the surface of the dielectric layer 24 in cells 340 in which a discharge has been accumulated exceeds a discharge firing voltage. This discharge (in other words surface discharge) is sustained for a period during which the sustain pulses are applied (the discharge sustain period shown in FIG. 3).

Following this, the panel driver 1 applies a narrow pulse to the X electrodes 22 via the scan driver 103, generating an imperfect discharge in order to reduce the wall charge, and erase the screen (erase period). By repeating these operations, the panel driver 1 displays a screen on the panel 2.

This completes the explanation of the overall structure of the panel driver 1 and the panel 2 of the present PDP, and of the general operations thereof. The present invention is mainly characterized by a structure focusing on the display electrodes 22 and 23.

Figure 4:
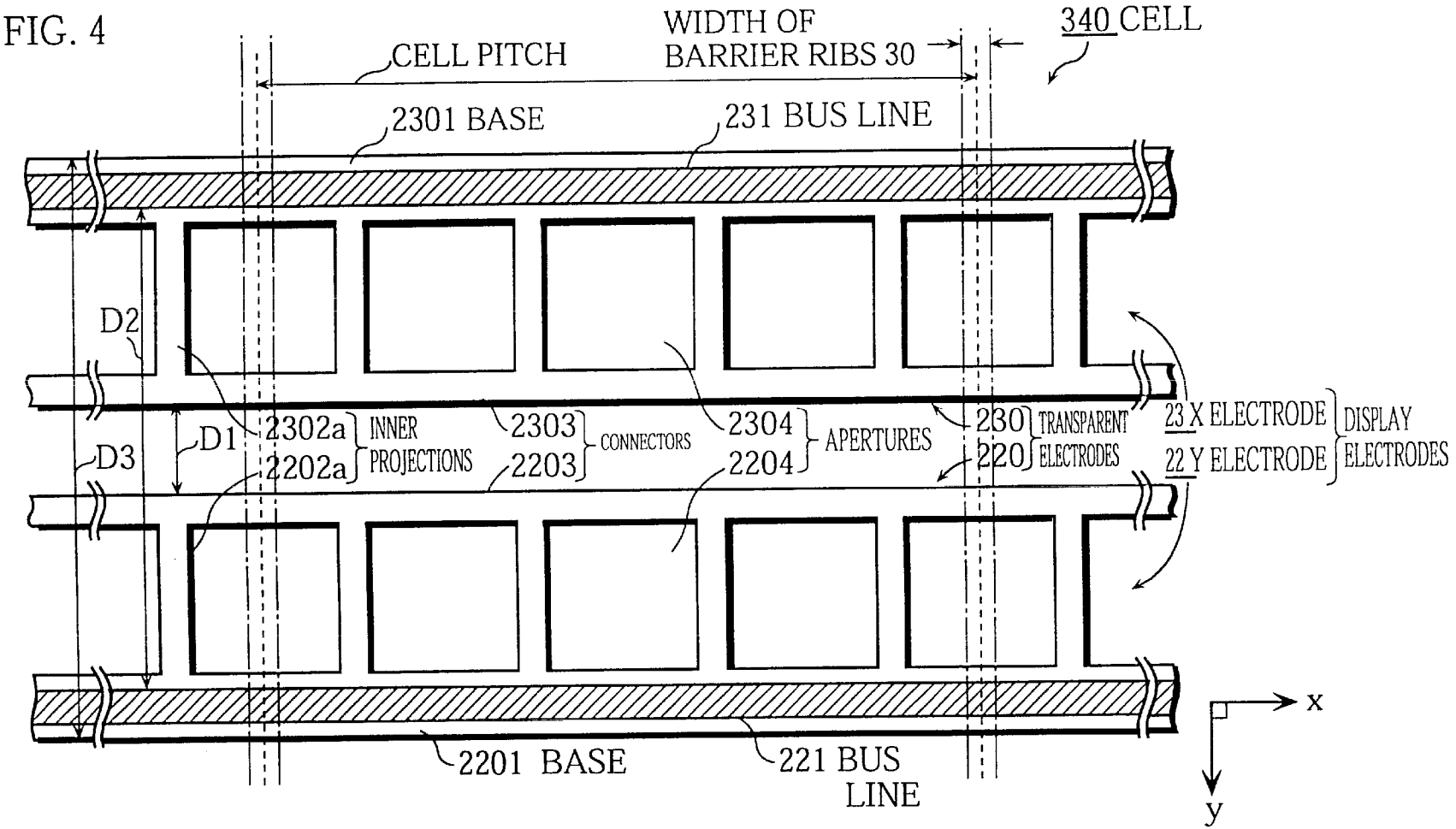
FIG. 4 is an aerial view showing display electrodes in the PDP of the first embodiment.

FIG. 4 is a partial aerial view of display electrodes 22 and 23 formed on the front panel 21 of the PDP, seen from the z direction (the depth of the PDP). In the drawing, two dashed lines running parallel to the y direction indicate a cell pitch (360 $\mu$m) between two neighboring barrier ribs 30 in the x direction. Furthermore, the distance between parallel chain lines on either side of each dashed line corresponds to the thickness of the barrier ribs 30.

Note that FIG. 4, and the following drawings FIGS. 5 to 9 and FIG. 11 omit the address electrodes 28 for the sake of simplicity.

A pair of display electrodes 22 and 23 are mainly constructed from transparent electrodes 220 and 230, and bus lines 221 and 231. The transparent electrodes 220 and 230 are formed of indium tin oxide (ITO), and the bus lines 221 and 231 from Cr—Cu—Cr or mainly from Ag (in this description Ag is used).

The transparent electrodes 220 and 230 are formed from bases 2201 and 2301, inner projections 2202*a* and 2302*a*, and connectors 2203 and 2303.

The bases 2201 and 2301 are strips extending in the x direction (40 μm in the y direction×4 μm in the z direction). The bus lines 221 and 231 are strips (30 μm× in the y direction×4 μm in the z direction) laminated along the tops of the bases 2201 and 2301 so as to be electrically connected.

The inner projections 2202*a* and 2302*a* are narrow bands 40 μm in the x direction×80 μm in the y direction×0.5 μm in the z direction, extending from the bases 2201 and 2301 in gaps between each pair of display electrodes 22 and 23, and arranged a fixed distance (50 μm) apart in the x direction. In the first embodiment of this invention, the inner projections 2202*a* and 2302*a* are arranged four to each cell pitch (a total of eight for a pair of display electrodes 22 and 23).

The connectors 2203 and 2303 are strips (30 μm in the y direction×0.5 μm in the z direction) stretching in the x direction, and connecting the ends of the inner projections 2202*a* and 2302*a*.

By forming the transparent electrodes 220 and 230 in this way, a plurality of virtually rectangular (50 μm in the x direction×50 μm in the y direction) apertures 2204 and 2304 are lined up along the x direction in each cell pitch of the transparent electrodes 220 and 230, forming an array pattern.

Note that in FIG. 4, a minimum gap between a pair of display electrodes 22 and 23, in other words a discharge gap $D_1$ between connectors 2203 and 2303, is 40 μm, a discharge gap $D_2$ between neighboring bus lines 221 and 231 is 210 μm, and a maximum discharge gap $D_3$ between a pair of display electrodes 22 and 23 is 280 μm. Furthermore, a gap between neighboring pairs of display electrodes 22 and 23 in the y direction is set at 400 μm to prevent the generation of crosstalk and the like, and cell pitch in the y direction is 1080 μm. In FIG. 4, the characteristics of the shape of the transparent electrodes 220 and 230 in the first embodiment of the present invention are illustrated in a simplified manner, by showing the widths of and gaps between the bases 2201 and 2301, the inner projections 2202*a* and 2302*a* and the like as narrower than they actually are.

Display electrodes 22 and 23 having this kind of structure are manufactured taking the following points into account.

The ITO or similar used to form the transparent electrodes 220 and 230 has a higher electrical resistance than the metal (a composite formed mainly from Ag or similar) used to form the bus lines 221 and 231.

Here, all of the electric power supplied to the transparent electrodes 220 and 230 from outside may not necessarily be used as discharge for generating ultraviolet light, and as discharge itself, and may be wastefully consumed by being accumulated as unnecessary charges on the transparent electrodes 220 and 230.

Furthermore, even if transparent electrodes are used in the vicinity of the areas where the barrier ribs 30 and the transparent electrodes 220 and 230 intersect (in other words, areas of the transparent electrodes 220 and 230 near to the barrier ribs 30), little direct contribution to light emission is made and so this is likely to lead to the aforementioned excess electric consumption.

Here, the present invention reduces the parts of the transparent electrodes that generate excess electric consumption in a conventional PDP. Accordingly, the transparent electrodes 220 and 230 in the first embodiment have a well-balanced design that restricts consumption of electricity by having a smaller surface area than in the prior art, thereby preventing the accumulation of excess charges, and maintains a satisfactory level of surface discharge (in particular the amount that discharge extends in the x direction).

Furthermore, in the first embodiment, the discharge gaps for a pair of display electrodes 22 and 23 are formed in the following way in order to achieve satisfactory luminous efficiency. Firstly, the discharge gap $D_1$ between the inner projections 2202*a* and 2302*a* is set based on Paschen's law, which is wellknown in the art. In other words, when a discharge gas pressure is P, and a discharge gap d, a Paschen curve showing a relationship between a product of Pd and a discharge firing voltage is used to set the discharge gap $D_1$ at approximately 40 μm. This gap width is one at which the discharge firing voltage in relation to the above discharge gas pressure P ($2.6\times10^5$ Pa) is just slightly more than a minimum value, taking into account variations in individual PDPs created during production. In addition, based on the same Paschen curve, the gap $D_2$ between the bus lines 221 and 231 is set at a value at which the minimum discharge sustain voltage is in a vicinity of a minimum luminous efficiency value. The maximum discharge gap $D_3$ between a pair of display electrodes 22 and 23 is set so as to obtain a satisfactory level of surface discharge.

Note that the shape of the Paschen curve varies according to the type of discharge gas used, and so the values of $D_1$ to $D_3$ are characterized by dependency on the Paschen curve for each discharge gas. Therefore, when $D_1$ to $D_3$ are set, the most appropriate values for the conditions concerned should be investigated by reference to the appropriate Paschen curve.

Furthermore, as in the first embodiment, the plurality of inner projections 2202*a* and 2302*a* are connected electrically by the connectors 2203 and 2203, so there will be little impact on discharge even if a manufacturing error places the inner projections 2202*a* and 2302*a* slightly out of position.

During the initial part of a discharge sustain period when a PDP having the above structure is driven, a sustain pulse is applied to a pair of display electrodes 22 and 23, and surface discharge starts in discharge gaps $D_1$, in other words at the ends of the inner projections 2202*a* and 2302*a*, that are set at the optimum for the firing voltage as defined by Paschen's law. Since discharge gaps $D_1$ are about 40 μm, that is narrower than conventional gaps, the voltage required for starting discharge (discharge firing voltage) is less than in a PDP that is not provided with inner projections, and a satisfactory discharge can be produced while reducing electrical consumption.

Once discharge has started in the PDP of this invention, it spreads out in the x and y directions (across the panel surface) during the discharge sustain period, and the area of display electrodes 22 and 23 that contributes to this discharge is enlarged through provision of the bus lines 221 and 231. A particular characteristic of this invention is the placement of the connectors 2203 and 2303, which enables enlargement of discharge in the x direction to be achieved satisfactorily. In other words, the present invention uses the fact that the scale of discharge is enlarged over an area larger than the areas of the electrodes on which a charge is originally accumulated. Consequently, even if the surface area of the transparent electrodes 220 and 230 is reduced by providing the apertures 2204 and 2304, discharge, once initialized, also occurs in the apertures 2204 and 2304, enabling the scale of discharge to be maintained at a satisfactory level.

Discharge generated in the discharge gap $D_1$ spreads out over the maximum discharge gap $D_3$ between outer projections 222*b* and 232*b*, enabling discharge to occur over a wide area. Therefore, the invention of the first embodiment restricts excess electrical consumption, and maintains a satisfactory level of surface discharge. As a result, a PDP with a superior balance between light emission and electric consumption, in other words luminous efficiency, can be achieved.

Here, the cell pitch of the inner projections need not be limited to 4, and a different cell pitch may be used. Furthermore, the dimensions of the inner projections 2202*a* and 2303*a*, the connectors 2203 and 2303 and the like may be adjusted as appropriate according to cell size. However, if the connectors 2203 and 2303 or similar are too narrow, electrical resistance will increase, and excess electrical consumption may be generated through Joule heat loss and the like. Consequently, it is desirable to set these dimensions after experiments have been performed to ascertain the balance between electrical consumption and luminous efficiency. Furthermore, the dimensions of the transparent electrodes 220 and 230 in each of the following embodiments may be changed based on similar conditions.

The following is an explanation of the other embodiments. Note that only the particular characteristics of each embodiment are described to avoid duplicate explanation.

1-2 Second Embodiment

In the first embodiment the bases 2201 and 2301 have transparent electrodes 220 and 230, but the bases 2201 and 2301 may be omitted, and an improvement where the electrical consumption of the transparent electrodes 220 and 230 is further reduced in areas where the bases 2201 and 2301 and the bus lines 221 and 231 overlap achieved.

Figure 5:
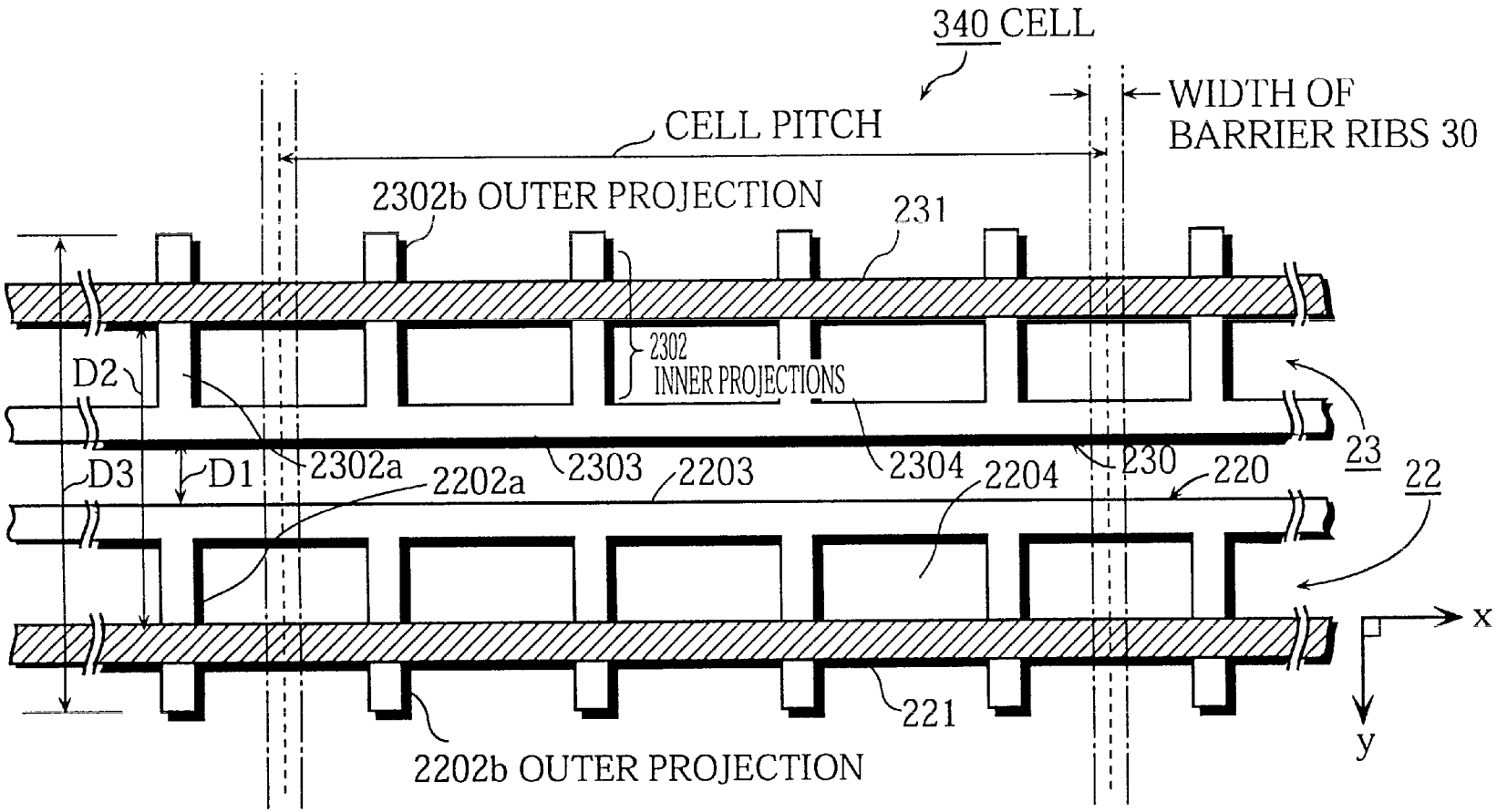
FIG. 5 is an aerial view showing display electrodes in the PDP of a second embodiment.
Figure 6:
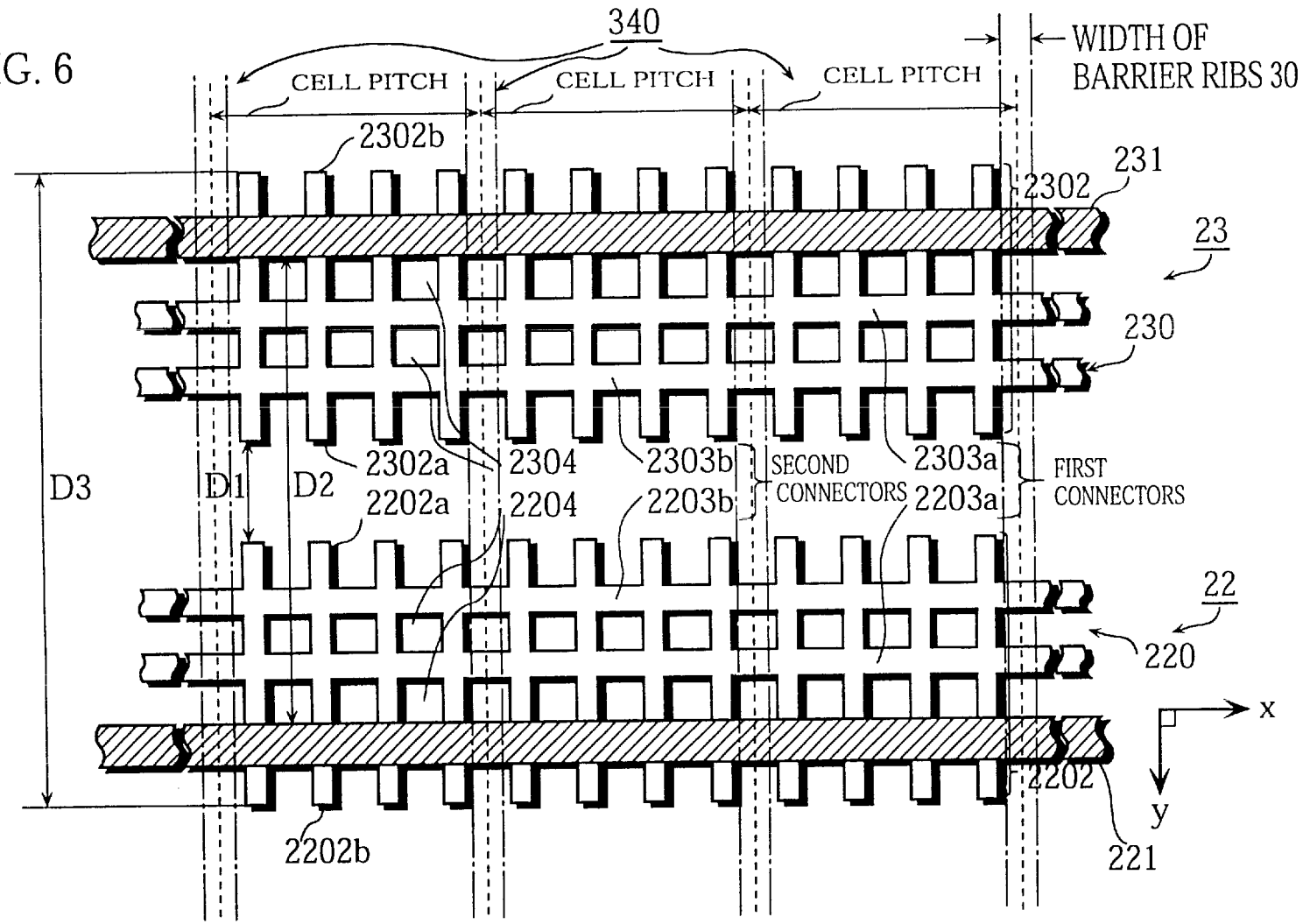
FIG. 6 is an aerial view showing display electrodes in the PDP of a third embodiment.

Here, the overhead view of a pair of display electrodes 22 and 23 in FIG. 5 shows the characteristic of the second embodiment that achieves the above improvement. In the second embodiment, in addition to the above improvement, outer projections 2202*b* and 2302*b* (each 40 μm in the x direction, 30 μm in the y direction, and 0.5 μm in the y direction), which are extensions of the inner projections 2202*a* and 2302*a*, are arranged so as to extend outwards from the gaps between the pair of display electrodes 22 and 23. In other words, in the second embodiment, projections 2202 and 2302 (40 μm in the x direction, 30 μm in the y direction, and 0.5 μm in the y direction), formed in one piece from the inner projections 2202*a* and 2302*a* and the outer projections 2202*b* and 2302*b*, intersect with the bus lines 221 and 231, and the ends of inner projections 2202*a* and 2302*a* connect with the connectors 2203 and 2303. As a result, the discharge gaps $D_1$, $D_2$, and $D_3$ are set at 40 μm, 200 μm, and 320 μm respectively.

Note that cell pitch in the x and y directions is set at 360 μm and 1080 μm respectively.

In addition to the effects produced in the first embodiment, the PDP of the second embodiment having the structure described above can be expected to achieve further improvements in power saving, since it reduces the excess electrical consumption caused by accumulation of charges when a PDP having bases 2201 and 2301 is driven during the discharge sustain period. Furthermore, the discharge generated spreads out from the bus lines 221 and 231 to the outer projections 2202*b* and 2302*b*, enlarging the scale of surface discharge generated by a corresponding amount, so that surface discharge with a satisfactory luminous efficiency can be achieved.

Note that only one of the outer projections 2202*b* and 2303*b* may be provided, but in order to ensure the satisfactory scale of surface discharge described above, both the outer projections 2202*b* and 2302*b* should preferably be provided.

1-3 Third Embodiment

The transparent electrodes 220 and 230 in the third embodiment are based on those in the second embodiment, and are additionally provided with a plurality of connectors. These are first connectors 2203*a* and 2303*a*, and second connectors 2203*b* and 2303*b*, which are structured so that projections 2204 and 2304 are connected by the first and second connectors 2203*a* to 2203*b*, as shown in the aerial view of a pair of display electrodes 22 and 23 in FIG. 6.

To be more specific, the bases 2201 and 2301 provided in the first embodiment are omitted, the projections 2202 and 2302 arranged to intersect with the bus lines 221 and 231, and the inner and outer projections 2202*a*, 2302*a*, 2202*b*, and 2302*b* are provided. In addition to this the first connectors 2203*a* and 2303*a* and the second connectors 2203*b* and 2303*b* are arranged in parallel with the x direction. This means that, in the third embodiment, the transparent electrodes 220 and 230 are formed in an array pattern in which a plurality of apertures 2204 and 2304 are arranged in a two-level matrix in the x and y directions.

The dimensions of each part included in the transparent electrodes 220 and 230 are, for example, as those shown below. Note that in FIG. 4, in order to make the shape of the transparent electrodes 220 and 230 easier to understand, the apertures 2204 and 2304 and the like have a shape that is. slightly different from their actual shape.

First connectors 2203*a*, 2303*a*, second connectors 2203*b*, 2303*b*: 20 μm in the y direction×0.5 μm in the z direction.

Apertures 2204, 2304: 50 μm in the x direction×10 μm in the y direction.

Inner projections 2202*a*, 2302*a*: 40 μm in the x direction× 80 μm in the y direction×0.5 μm in the z direction.

Outer projection 2202*b*, 2302*b*: 40 μm in the x direction× 30 μm in the y direction×0.5 μm in the z direction.

Cell pitch in x and y directions: 360 μm and 1080 μm respectively.

Discharge gaps $D_1$, $D_2$, $D_3$: 40 μm, 200 μm and 320 μm respectively.

In addition to the effects produced in the second embodiment, the PDP of the third embodiment having the structure described above can be expected to further improve the spread of surface discharge in the x direction from when the PDP is driven at the start of the discharge sustain period onward. This is achieved by providing a total of four connectors (first connectors 2203*a* and 2303*a*, and second connectors 2203*b* and 2303*b*).

1-4 Fourth Embodiment

Figure 7:
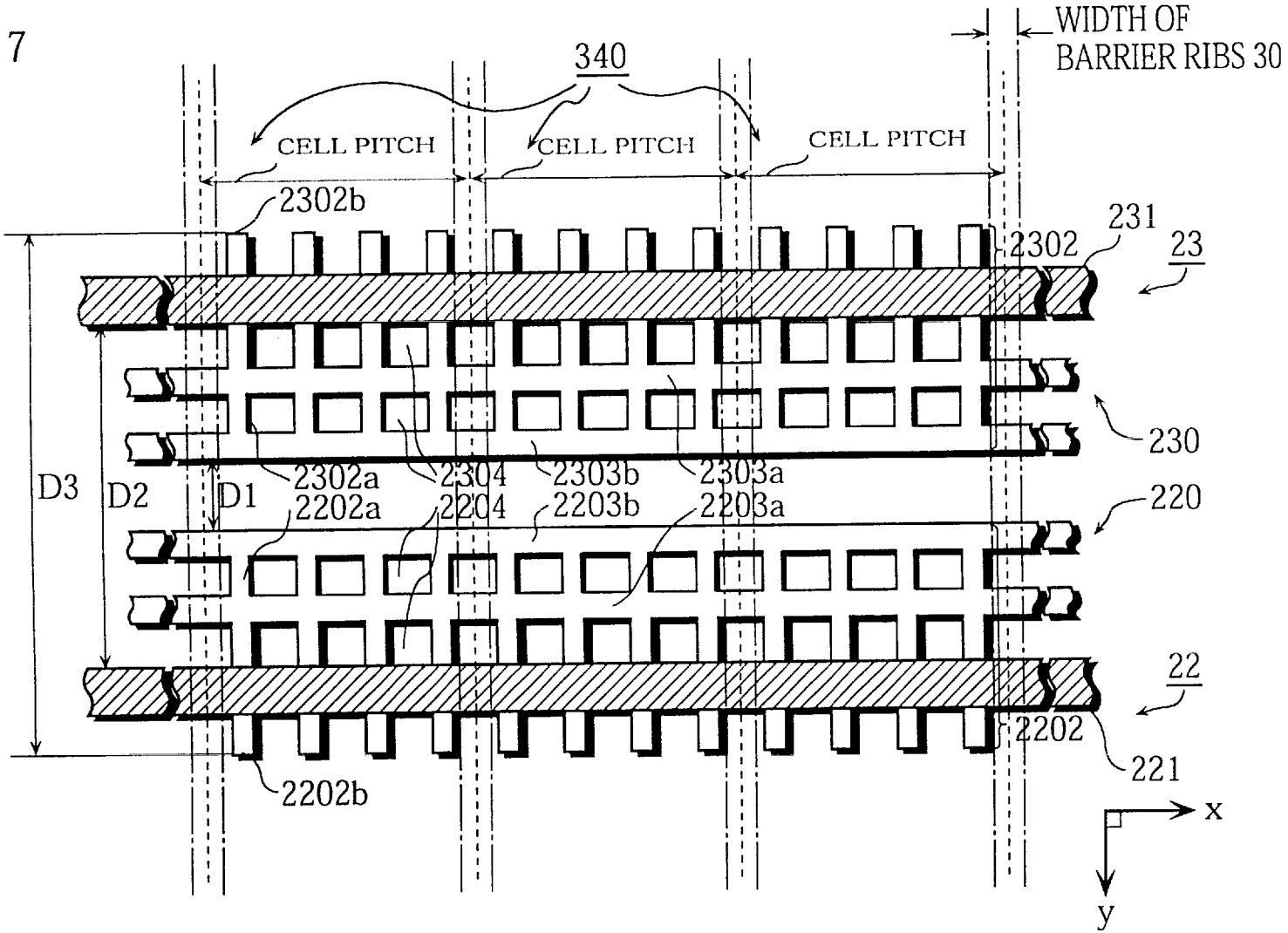
FIG. 7 is an aerial view showing display electrodes in the PDP of a fourth embodiment.

The PDP in the fourth embodiment has broadly the same structure as that in the third embodiment, as is shown in the aerial view of a pair of display electrodes 22 and 23 in FIG. 7. However, this PDP is characterized by having the ends of inner projections 2202*a* and 2302*a* aligned with the connectors (in the drawing with the second connectors 2203*b* and 2303*b*).

In addition to the effects produced in the third embodiment, the PDP of the fourth embodiment having the structure described above can generate a uniform discharge and generate discharge more easily when the PDP is driven at the start of the sustain discharge period. This is achieved due to the fact that a minimum discharge gap $D_1$ applicable for discharge initialization extends uniformly in the x direction.

1-5 Fifth Embodiment

Figure 8:
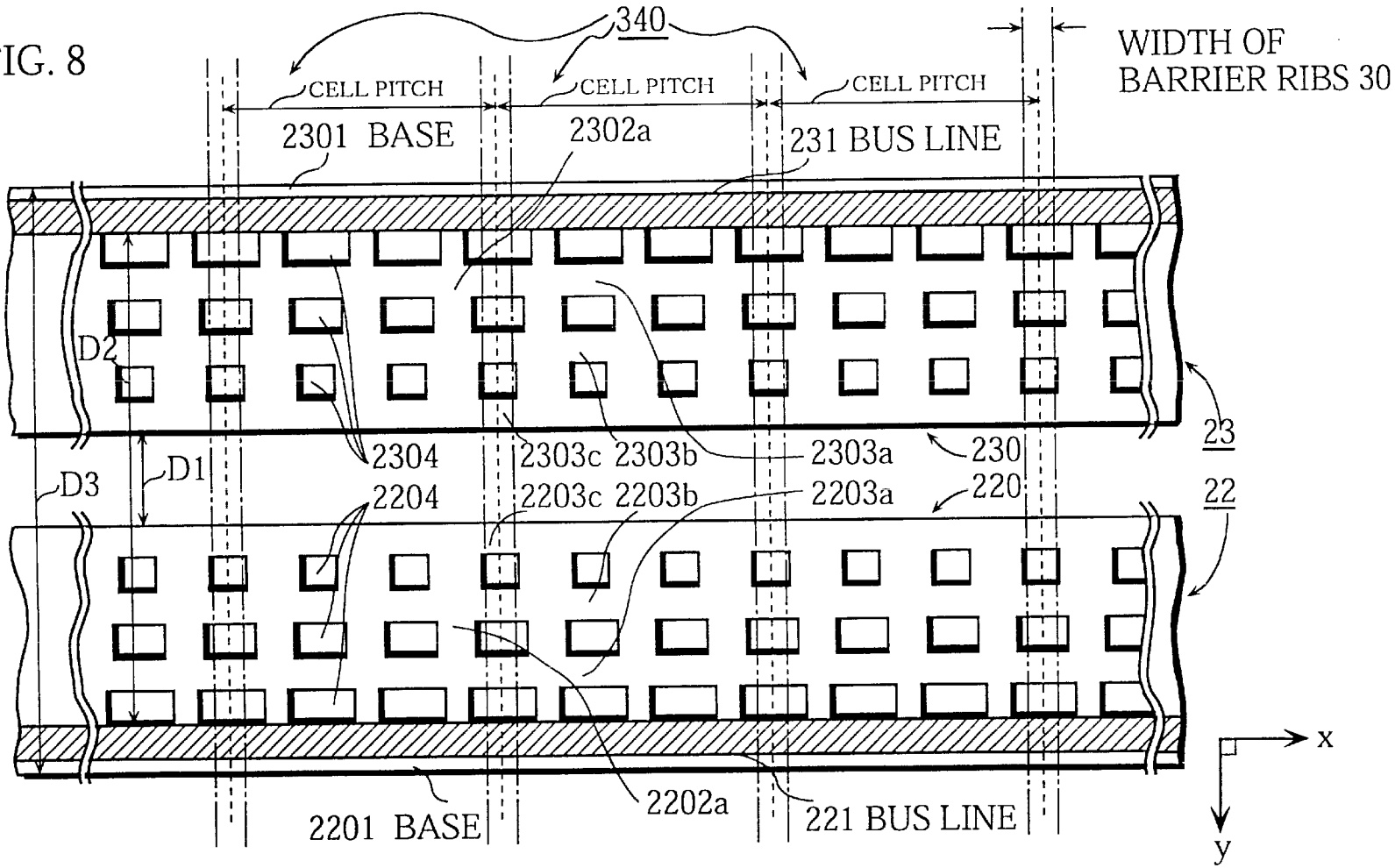
FIG. 8 is an aerial view showing display electrodes in the PDP of a fifth embodiment.
Figure 9:
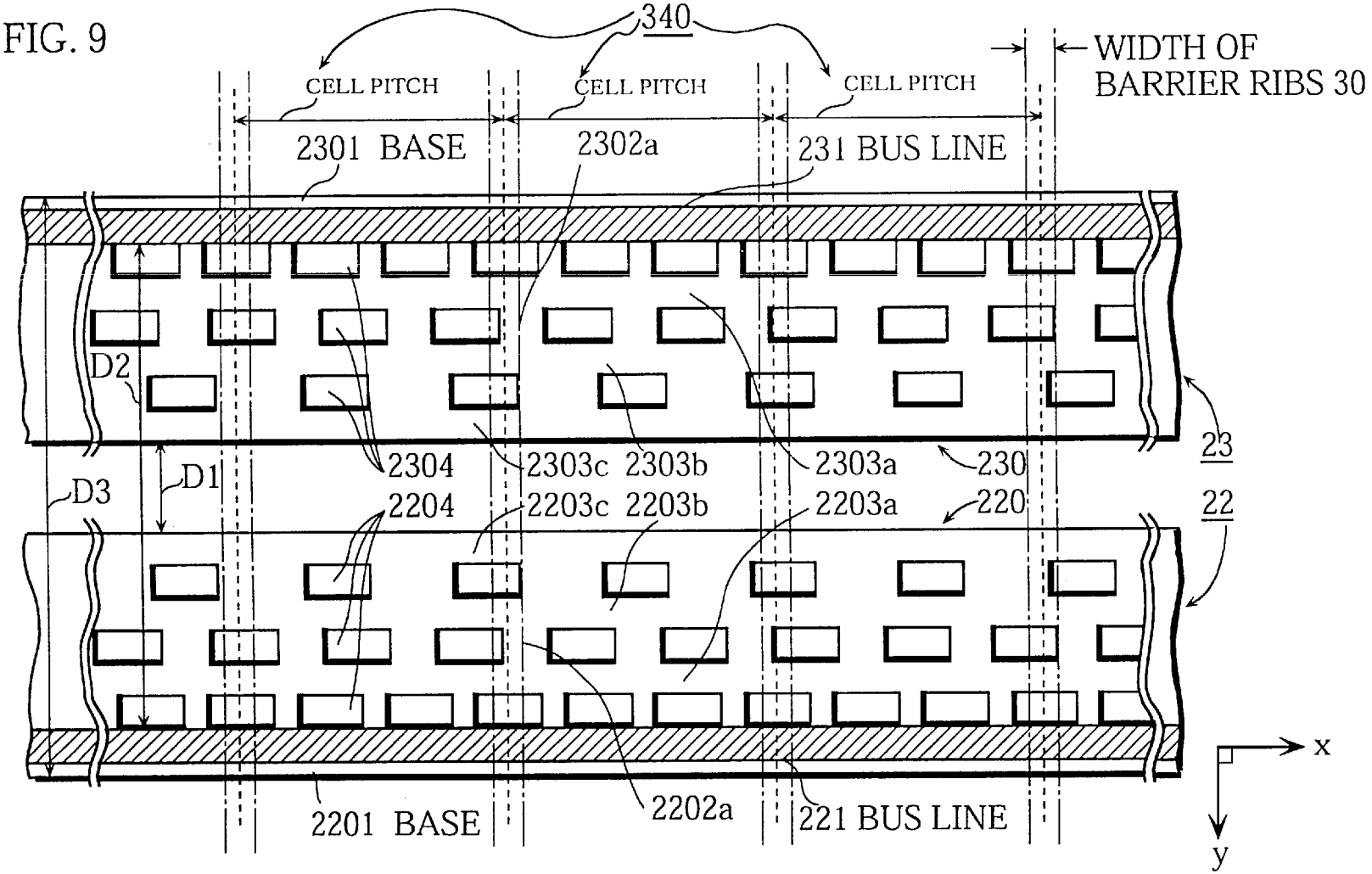
FIG. 9 is an aerial view showing an modification of the display electrodes in the fifth embodiment.

In the fifth embodiment, transparent electrodes 220 and 230 are provided with first to third connectors 2203*a* to 2203*c* and 2303*a* to 2303*c* in three lines parallel to the x direction, as shown in the aerial view of a pair of display electrodes 22 and 23 in FIG. 8. The third connectors 2203*c* and 2303*c* connect the ends of inner projections 2203*a* and 2303*a*. The size of apertures 2204 and 2304, which are formed in an array pattern having three levels along the y direction, is set so that apertures 2204 and 2304 in levels further from the gap between the pair of display electrodes 22 and 23 are smaller. The width of inner projections 2202*a* and 2302*a* in the x direction increases in levels nearer to the gap between the pair of display electrodes 22 and 23. The shape of such transparent electrodes 220 and 230 is set with the aim of increasing the accumulation of electric charge across discharge gap $D_3$ at points nearer to the gap $D_1$.

In the PDP of the fifth embodiment having this structure, a satisfactory discharge can be started by accumulating a sufficient charge. This is achieved due to the fact that a charge can be accumulated most easily in the vicinity of the minimum gap $D_1$ between a pair of display electrodes 23 and 23 when the PDP is driven at the start of the discharge period. Following this, once surface discharge has stabilized, discharge spreads out across to parts of gaps $D_2$ and $D_{31}$ which have less charge than $D_1$, so that discharge is generated across a wide area. By accumulating an appropriate amount of charge on the transparent electrodes 220 and 230 according to the amount required, consumption of excess power can be avoided, and a PDP with an excellent power consumption/luminous efficiency balance can be achieved.

Note that FIG. 8 shows an example in which the size of the apertures 2204 and 2304 is gradated, but a similar effect may also be achieved by keeping the size of the apertures 2204 and 2304 uniform, and increasing the pitch between neighboring apertures 2204 and 2304 (in other words the width of inner projections 2203*a* and 2303*a* in the x direction) that are nearer to the gap $D_1$.

Furthermore, the fifth embodiment describes a structure in which charges can be more easily accumulated in areas of the transparent electrodes 220 and 230 in the vicinity of the minimum discharge gap $D_1$, and in which the amount of charge accumulated is reduced moving out across the maximum discharge gap $D_3$. However, the invention need not be limited to this structure, and the amount of charge accumulated on a pair of display electrodes 22 and 23 may be set in a different way. For example, the position of apertures 2204 and 2304 arranged in the three-level array pattern in FIG. 8 may be altered so that the apertures 2204 and 2304 are arranged in the size order large→small→medium moving from the minimum discharge gap $D_1$ toward the bus lines 221 and 231. As a result, the amount of charge accumulated on the transparent electrodes 220 and 230 is small→large→medium, moving in the same direction. By using such a structure, an effect can be obtained such that a large number of phosphors can be excited in areas having a high accumulation of discharge, that is areas with high energy efficiency, during a discharge process in which discharge spreads out from the discharge gaps toward the bus lines 221 and 231.

1-6 Sixth Embodiment

Figure 10:
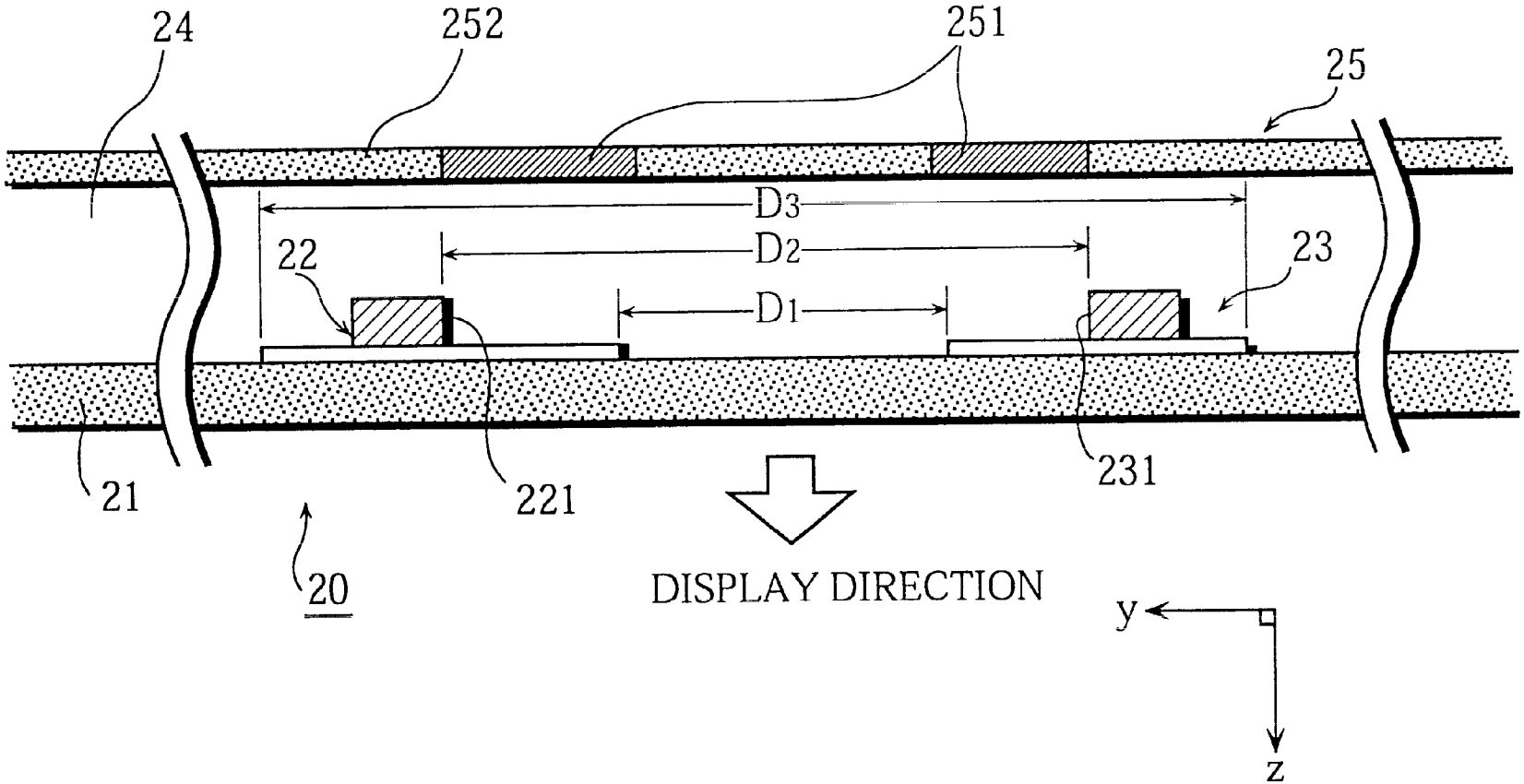
FIG. 10 is a partial cross-section of a PDP in a sixth embodiment.

The structure of a pair of display electrodes 22 and 23 in the sixth embodiment is broadly the same as that in the first embodiment (see FIG. 4), the sixth embodiment being characterized by the structure of the protective layer 25. FIG. 10 is a partial cross-section across the depth of the PDP (z direction).

Here, a protective layer 251 of magnesium oxide (MgO) is formed on top of the dielectric layer 24 that covers the whole of the front glass substrate 21, over areas that correspond to the inner projections 2202*a* and 2302*a* (in FIG. 10 these areas are directly above the inner projections 2202*a* and 2302*a*), and a protective layer 252 of aluminum ($Al_2O_3$) is formed over remaining areas.

In a PDP with this kind of structure, the magnesium oxide has a higher rate of electron emission than the aluminum. As a result, at the start of the discharge sustain period when the PDP is driven, discharge can be generated more easily in the minimum discharge gap $D_1$, the discharge firing voltage is restricted, and electric consumption when discharge is started is also restricted. Following this, the whole of cells 340 are filled with electrons. Once sustain discharge begins, discharge is also generated by the aluminum protective layer 252, but this has little impact on light emission, restricting excess electron emission, and results in a reduction in the amount of electric current. The light emitting area at this time is satisfactorily maintained, as in the other embodiments.

Note, that the material with a low electron emission yield used for the protective layer need not be limited to aluminum, and other materials may be used. Furthermore, the shape of the display electrodes need not be limited to that described in the previous embodiments, and may be changed as appropriate in so far as is possible. In addition, the method for arranging the magnesium oxide protective layer 251 need not be limited to that described above, where it is arranged in correspondence with the inner projections 2202*a* and 2302*a*. A similar effect can be expected if the magnesium oxide protective layer 251 is arranged uniformly across an area extending from the positions shown in FIG. 10 to an area corresponding to the discharge gap $D_1$.

Furthermore, the sixth embodiment is explained based on the first embodiment, but it may also be based on any of the other embodiments.

The above explanation referred to the first to sixth embodiments, but the present invention need not be limited to a method in which display electrodes include projections formed of transparent electrode material, and bus lines formed of metal. In other words, both may be made from the same material. This simplifies the manufacturing process, and is particularly valuable when manufacturing the intricate display electrodes required for a high definition PDP. To be specific, the display electrodes should preferably be made entirely of metal. In this case, a material formed mainly of Ag is ideal, but Cr—Cu—Cr or similar may also be used. The resistance value of the display electrodes can be lowered further if they are made mainly of Ag than if they are made of Cr—Cu—Cr.

Experiments performed by the inventors clearly show that when display electrodes are formed mainly from Ag, the reflection coefficient of discharge emission reflected by the display electrodes ranges from 80% to a maximum of 95% or more. Therefore, even if light generated inside the cells strikes the display electrodes, most of this light will be returned to the inside of the cell without being extinguished (this holds true even if the discharge emission is reflected three or four times). As a result, discharge generated by the display electrodes contributes to an efficient light display without having an adverse effect on the cell aperture ratio. Note that the transmission coefficient for visible light when using conventional transparent electrodes of the prior art is confined to a value of around 80% or less, and thus obtaining the superior discharge efficiency of the present invention is difficult.

The present invention may further perform black matrix processing on the display electrodes.

Figure 11:
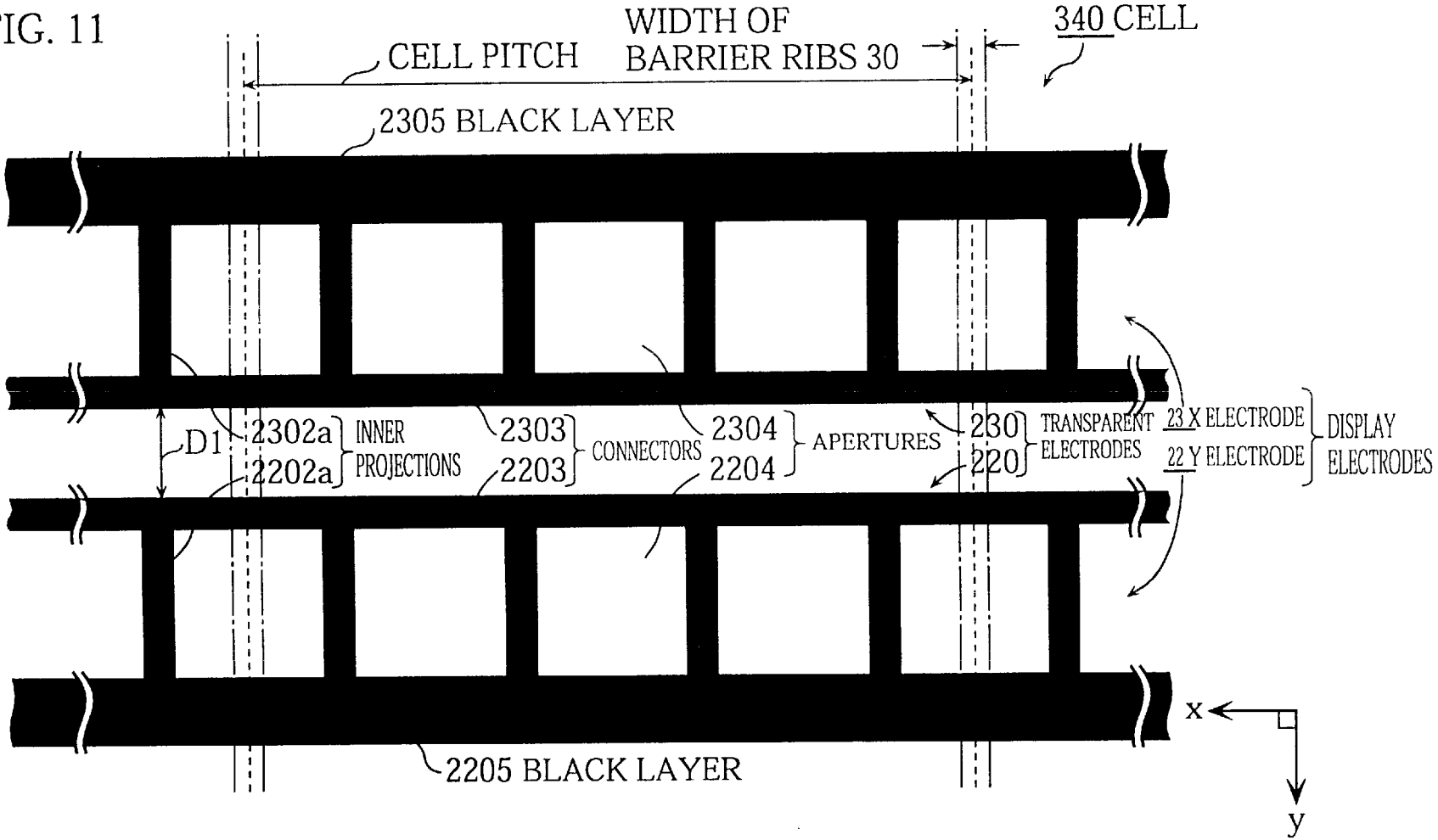
FIG. 11 is an aerial view of the display electrodes in the first embodiment on which black matrix processing has been performed.

FIG. 11 shows an aerial view of the display electrodes in the first embodiment seen from in front of the PDP. Black matrix processing involves forming black layers 2205 and 2305 using a black material, being a metal including a metal oxide or Ag at positions on the front glass substrate where the transparent electrodes are to be formed, before forming the display electrodes.

By performing such black matrix processing, visible light admitted into the display from the outside will be prevented from reflecting off the display electrodes 22 and 23 when the PDP is driven during the discharge sustain period. This enables a display with visibility markedly superior to the prior art to be achieved.

Note, that here an example in which black matrix processing is applied to display electrodes 22 and 23 in the first embodiment is described, but in the present invention, black matrix processing may also be applied to display electrodes having a different shape, and to display electrodes formed solely from metal.

2. PDP Manufacturing Method

The following is an explanation of one example of a manufacturing method used to manufacture the PDP described in the above embodiments.

2.1 Manufacture of Front Substrate

Display electrodes are manufactured on the surface of a front glass plate formed of a 2.6 mm thick soda lime glass plate. This is performed by first forming transparent electrodes using photoetching as follows.

A photoresist (for example, a resin that hardens when exposed to ultraviolet light) with a thickness of 0.5 $\mu$m is applied to the entire top surface of the front glass plate. Then, a photo mask having a certain pattern is placed on top of the photoresist, and ultraviolet light applied. The front glass plate is immersed in a developer, and the parts of the resin that have not been hardened are washed away. Next, ITO or similar is applied to the gaps in the photoresist on the front glass panel using a chemical vapor deposition (CVD) method. Following this, the photoresist is eliminated by a cleaning solvent to obtain the transparent electrodes.

Next, bus lines with a thickness of 4 $\mu$m are formed on top of the transparent electrodes from a metal with Ag or Cr—Cu—Cr as its main component. If Ag is used, this is performed by screen printing, and if Cr—Cu—Cr is used, by a vapor deposition or spattering method.

Note that display electrodes manufactured from a metal with Ag or the like as its main component may be manufactured simply by using the above described photoetching.

Next, the entire surface of the front glass plate including the tops of the display electrodes is coated with a lead glass paste to a thickness of 15 to 45 $\mu$m, and baked to form a dielectric layer.

Following this, a protective layer 0.3 to 0.6 $\mu$m thick is formed on the surface of the dielectric layer using a vapor deposition method, CVD or similar. The protective layer is basically formed using magnesium oxide (MgO), but when parts of the protective layer use a different substance, as for example when a distinction is made between the use of MgO and aluminum ($Al_2O_3$), the protective layer is formed by patterning using an appropriate metal mask.

This completes the manufacture of the front substrate.

2-2. Manufacture of Back Substrate

The surface of a back glass plate formed of a 2.6 mm soda lime glass plate is coated with a conductive material having Ag as its main component, stripes being formed at regular intervals using screen printing. These stripes are address electrodes having a thickness of 5 $\mu$m. Here, the manufactured PDP is a 40 inch NTSC (National Television System Committee) or VGA (Video Graphics Array) standard model, so neighboring address electrodes are set at intervals of no more than 0.4 mm apart.

Following this, a lead glass paste is coated at a thickness of 20 to 30 $\mu$m over the entire surface of the back glass plate on which the address electrodes have been formed, and then baked to form a dielectric film.

Next, barrier ribs approximately 60 to 100 $\mu$m high are formed on top of the dielectric film in the gaps between neighboring address electrodes, using the same lead glass material. These barrier ribs are formed, for example, by performing screen printing repeatedly using the lead glass material, and then baking the result.

Once the barrier ribs have been formed, phosphor inks, each including phosphors in one of the three colors red, green and blue, are applied to the surfaces of the barrier ribs and to the surface of the dielectric layer exposed between the barrier ribs, and then dried and baked to form phosphor layers.

Examples of the phosphors conventionally used in PDPs are described below.

Red phosphor: $(Y_xGd_{1-x})BO_3:Eu^{3+}$

Green phosphor: $Zn_2SiO_4:Mn$

Blue phosphor: $BaMgAl_{10}O_{17}:Eu^{3+}$ (or $BaMgAl_{14}O_{23}:Eu^{3+}$)

Powder with an average particle size of, for example, 3 $\mu$m is used for each phosphor. A variety of methods may be used to apply the phosphor ink, but here a meniscus method wellknown in the art is used. In this method phosphor ink is squirted from a fine nozzle by forming a meniscus (bridge using surface tension). The method is ideal for coating the target area uniformly with phosphor ink. However, the present invention need not of course be limited to this method, and another method such as screen printing may also be used.

This completes the manufacture of the back substrate.

Note that the front and back glass plates are described as being made from soda lime glass, but this is just one example of a material which may be used.

2-3 Finishing of PDP

The manufactured front and back substrates are sealed together using sealing glass. Then, the discharge spaces are exhausted to form a high vacuum of around $1.1\times10^{-4}$ Pa, and filled with a discharge gas such as an Ne—Xe mixture, a He—Ne—Xe mixture or a He—Ne—Xe—Ar mixture at a specified pressure (here $2.7\times10^5$ Pa).

Note that experiments have shown that setting pressure at a range of between $1.1\times10^5$ Pa and $5.3\times10^5$ Pa when the gas is introduced improves luminous efficiency (this technique is described in more detail in Japanese Patent H9-141954).

3. Other Considerations

Each of the first to sixth embodiments describes an example in which transparent electrodes 220 and 230 are formed symmetrically on a pair of display electrodes 22 and 23, but the transparent electrodes 220 and 230 need not necessarily be formed symmetrically. Instead, only one of the transparent electrodes 220 and 230 need be provided with the inner projections 2202*a* and 2302*a*, and the connectors 2203 and 2302*b*. In addition, one of a pair of display electrodes may be formed of a metal electrode (in other words be only a bus line), and the other from a transparent electrode and a bus line.

Furthermore, the first to sixth embodiments describe an example in which inner projections 2202*a* and 2302*a* are arranged facing each other in the y direction, but the present invention need not be limited to this structure, and the inner projections 2202*a* and 2302*a* may be arranged in positions that are slightly out of line along the x direction.

Furthermore, the pitch at which the inner projections 2202*a* and 2302*a* are arranged in the x direction may vary for each pair of transparent electrodes 220 and 230. However, keeping the pitch of the inner projections 2202*a* and 2302*a* uniform is thought to enable a uniform discharge to be generated in each cell, and so this is preferable.

The second to fourth embodiments describe examples in which outer projections 2202*b* and 2302*b* are provided, but these need not be provided.

Furthermore, the outer projections 2202*b* and 2302*b* may be provided on only one of the transparent electrodes 220 and 230.

In addition, the outer projections 2202*b* and 2302*b* are described as forming one whole with the inner projections 2202*a* and 2302*a*, and are collectively referred to as the projections 2202 and 2303, but the outer projections 2202*b* and 2302*b* may be formed separately from the inner projections 2202*a* and 2302*a*.

Furthermore, the inner projections 2202*a* and 2302*a*, and the outer projections 2202*b* and 2302*b* need not be provided in equal numbers, and their relative size may also be changed as appropriate.

Furthermore, provision of the connectors need not be limited to the inner projections 2202*a* and 2302*a*, and they may also be provided for the outer projections 2202*b* and 2302*b*.

Furthermore, the connectors 2203*a* . . . need not be limited to the numbers described in the first to sixth embodiments, and the number provided may be adjusted as appropriate. However, in this case, too many connectors may lead to accumulation of excess charge, and so care needs to be taken so as not to destroy the advantage gained over conventional transparent electrodes.

Furthermore, the shape of the apertures need not be limited to a rectangle (or square), but may be another shape. Furthermore, the inner projections 2202*a* and 2302*a* and the outer projections 2202*b* and 2302*b* need not be orthogonal to the bus lines, and may be slanted at an angle.

Figure 12:
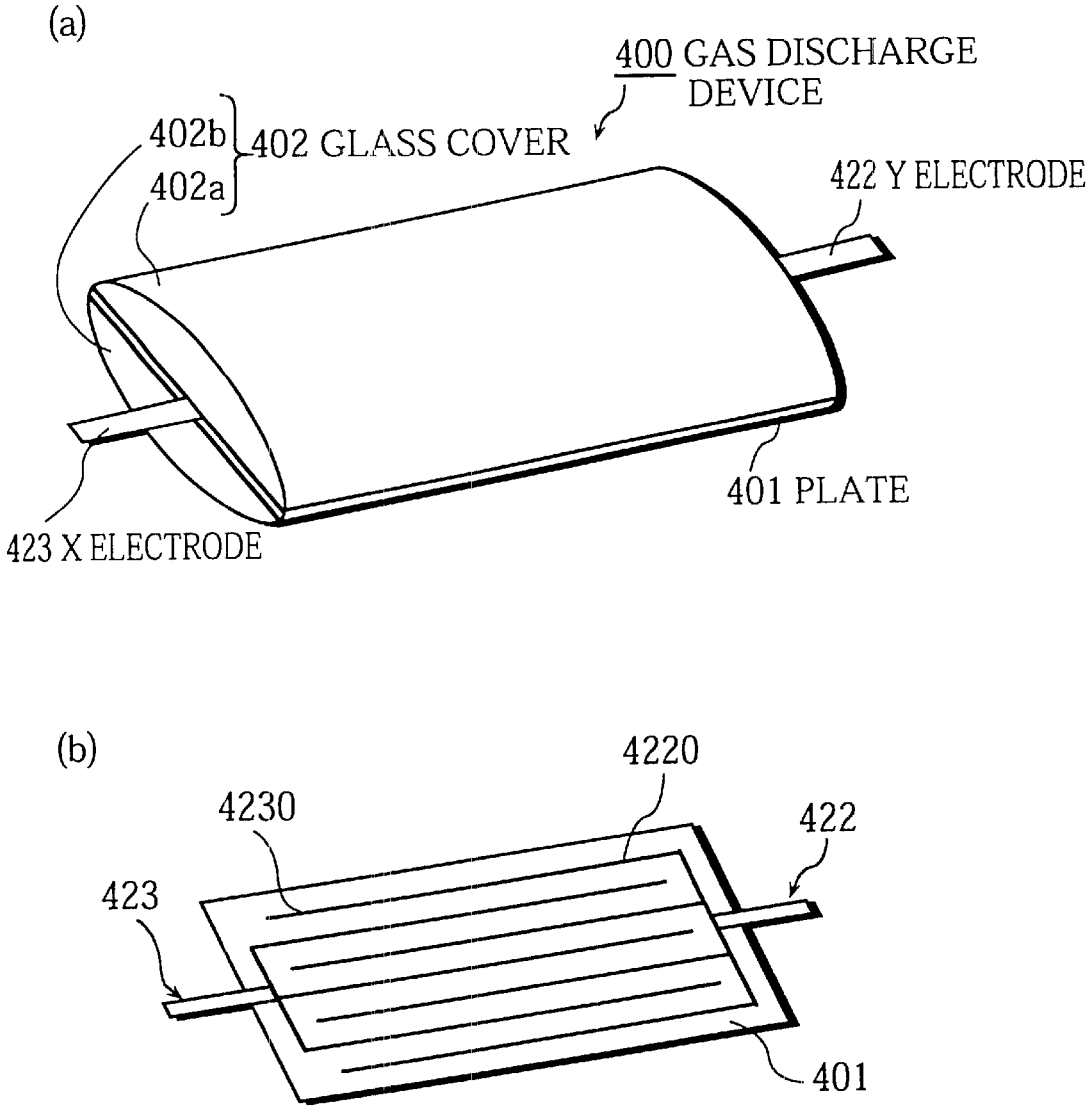
FIG. 12 shows a structure of a gas discharge device that is an example application of the present invention.
Figure 13:
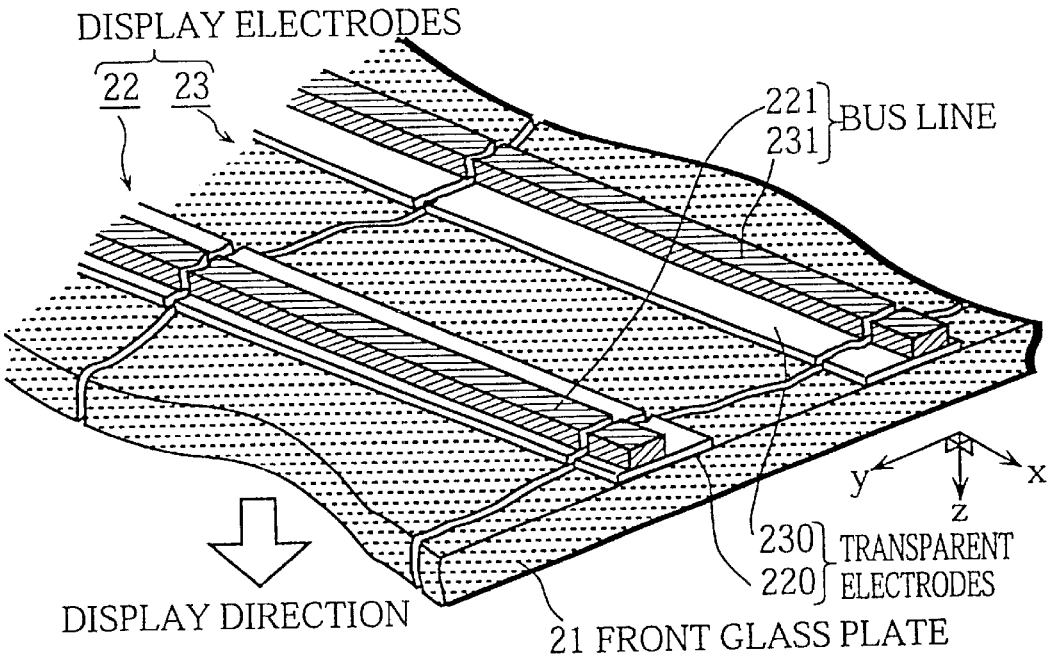
FIG.13 PRIOR ART
FIG. 13 is an aerial view showing display electrodes in a conventional PDP.
Figure 13:
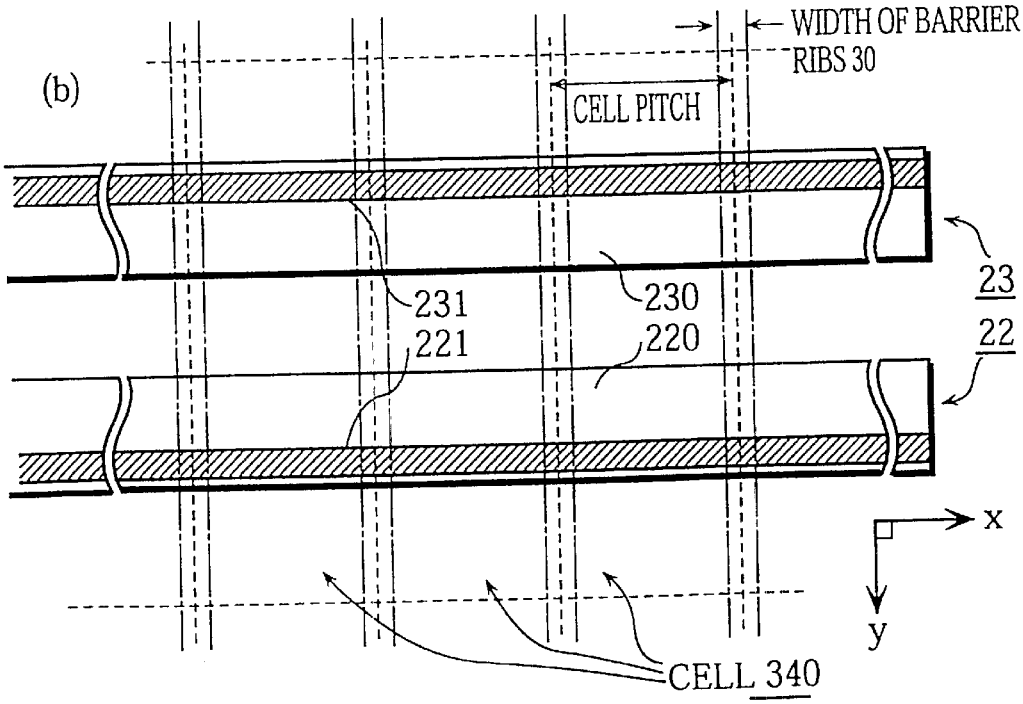
FIG.13 PRIOR ART

The first to sixth embodiments describe an example in which the present invention is used in a gas discharge panel (PDP). However, the application of the present invention is not limited to gas discharge panels, and it may also be used in other devices (gas discharge devices). One example of such a gas discharge device is shown in FIG. 12. A gas discharge device 400 shown in FIG. 12A has a structure in which discharge electrodes (display electrodes) 422 and 423 (Y electrode 422 and X electrode 423) are arranged on a plate 401, and both surfaces of the plate 401 are enclosed by glass covers 401*a* and 401*b* having a concave shape. The glass covers 401*a* and 401*b* are brought into close contact, and discharge gas introduced in the space between them. The display electrodes 422 and 423 each have a plurality of rake-like electrode lines 4220 and 4230, which are arranged in an interlocking pattern on the surface of the plate 401. These electrode lines 4220 and 4230 form the main part of the electrode (or the bus line), and inner projections 2202*a* and 2302*a*, outer projections 2202*b* and 2302*b* and the like are arranged as appropriate. The present invention may be applied to the display electrodes 422 and 423 in a gas discharge device such as this one.

Furthermore, the black matrix processing described above may be performed on the display electrodes 422 and 423 in the gas discharge device 400.

Industrial Applicability

The gas discharge display apparatus and manufacturing method thereof in the present invention are to be used mainly for high definition PDPs and the manufacture thereof.

What is claimed is:

1. A gas discharge display apparatus, in which a plurality of cells filled with a discharge gas are arranged in a matrix pattern in a space between first and second substrates placed in opposition to each other, at least one pair of display electrodes being arranged on a surface of the first substrate facing the second substrate so as to span the plurality of cells, each pair of display electrodes comprising:

two extension parts that extend lengthwise along the matrix;

a plurality of inner projections electrically connected to each extension part, and protruding toward the other extension part; and at least two connectors arranged, keeping a fixed interval therebetween, between the two extension parts, each connector electrically connecting at least two inner projections provided for a same extension part.

2. The gas discharge display apparatus of claim 1, wherein the gas discharge display apparatus is a plasma display panel.

3. The gas discharge display apparatus of claim 1, wherein a same extension part is provided with a plurality of connectors so as to electrically connect the at least two inner projections provided for the same extension part, thereby forming aperture array patterns, each having a plurality of apertures formed lengthwise along each extension part in the pair of display electrodes, aperture array patterns being formed in at least two rows extending widthwise from each extension part.

4. The gas discharge display apparatus of claim 1, wherein each connector is a strip arranged in parallel with the extension parts.

5. The gas discharge display apparatus of claim 3, wherein a size of the plurality of apertures provided for each extension part varies for each aperture array pattern.

6. The gas discharge display apparatus of claim 5, wherein the size of the plurality of apertures provided for each extension part becomes larger for array patterns further away from a minimum gap between the pair of display electrodes.

7. The gas discharge display apparatus of claim 3, wherein each of the aperture array patterns provided for a same extension part has a different pitch.

8. The gas discharge display apparatus of claim 7, wherein aperture array patterns provided for a same extension part that are further from the minimum gap between the pair of display electrodes have a narrower pitch.

9. The gas discharge display apparatus of claim 1, wherein ends of the at least two inner projections provided for each of the two extension parts are electrically connected by a connector, and a gap between the connectors provided for the extension parts is the minimum gap between the pair of display electrodes.

10. The gas discharge display apparatus of claim 1, wherein one or more outer projections are arranged transversely so as to protrude from at least one of the two extension parts on a side facing away from the other extension part.

11. The gas discharge display apparatus of claim 1, wherein the extension parts are bus lines formed of metal, and the inner projections are formed of a transparent electrode material.

12. The gas discharge display apparatus of claim 11, wherein the bus lines are formed mainly of Ag.

13. The gas discharge display apparatus of claim 1, wherein the at least one pair of display electrodes is formed mainly of Ag.

14. The gas discharge display apparatus of claim 1, wherein, when a discharge gas pressure is P and a discharge gap d, and a relation between product Pd and discharge firing voltage is shown by a Paschen curve, a minimum gap between the pair of display electrodes corresponds to a gap at a minimum discharge firing voltage or a vicinity thereof.

15. The gas discharge display apparatus of claim 1, wherein a black layer forming a black matrix that corresponds to a pattern formed by the at least one pair of display electrodes is arranged between the at least one pair of display electrodes and the first substrate on which the at least one pair of display electrodes are formed.

16. The gas discharge display apparatus of claim 15, wherein the black layer forming the black matrix is formed of a metal that includes one of a metal oxide and Ag.

17. A gas discharge display apparatus, in which at least one pair of discharge electrodes is arranged facing a discharge space filled with discharge gas, the gas discharge display apparatus emitting light when a discharge is generated between each pair of discharge electrodes by supplying electricity to the at least one pair of discharge electrodes, each pair of discharge electrodes comprising:

two extension parts that extend in a same direction;

a plurality of inner projections electrically connected to each extension part, and protruding toward the other extension part; and at least two connectors arranged, keeping a fixed interval therebetween, between the two extension parts, each connector electrically connecting at least two inner projections provided for a same extension part.

18. The gas discharge display apparatus of claim 17, wherein a same extension part is provided with a plurality of connectors so as to electrically connect the at least two inner projections provided for the same extension part, thereby forming aperture array patterns, each having a plurality of apertures formed lengthwise along each extension part in the pair of discharge electrodes, aperture array patterns being formed in at least two rows extending widthwise from each extension part.

19. The gas discharge display apparatus of claim 17, wherein each connector is a strip arranged in parallel with the extension parts.

20. The gas discharge display apparatus of claim 17, wherein ends of the at least two inner projections provided for each of the two extension parts are electrically connected by a connector, and a gap between the connectors provided for the extension parts is the minimum gap between the pair of discharge electrodes.

21. The gas discharge display apparatus of claim 17, wherein one or more outer projections are arranged transversely so as to protrude from at least one of the two extension parts on a side facing away from the other extension part.

22. The gas discharge display apparatus of claim 17, wherein, when a discharge gas pressure is P and a discharge gap d, and a relation between product Pd and discharge firing voltage is shown by a Paschen curve, a minimum gap between the pair of discharge electrodes corresponds to a gap at a minimum discharge firing voltage or a vicinity thereof.

23. The gas discharge display apparatus of claim 1, wherein a black layer forming a black matrix that corresponds to a pattern formed by the at least one pair of discharge electrodes is arranged on at least one part of a surface of the at least one pair of discharge electrodes.

24. The gas discharge display apparatus of claim 23, wherein the black layer forming the black matrix is formed of a metal that includes one of a metal oxide and Ag.

25. A gas discharge display apparatus manufacturing method including, in the stated order, a first step of arranging at least one pair of display electrodes across a surface of a first substrate, and a second step of placing the surface of the first substrate on which the at least one pair of display electrodes are arranged in opposition to a surface of a second substrate, with a plurality of barrier ribs interposed therebetween, areas where pairs of display electrodes intersect with gaps between neighboring barrier ribs forming cells for a light-producing display, the first step comprising, to form a pair of display electrodes:

a bus line arranging step of arranging two bus lines;

a projection arranging step of arranging a plurality of inner projections electrically connected to each bus line and protruding toward the other bus line; and a connector arranging step of arranging, keeping a fixed interval therebetween, at least two connectors between the two extension parts, each connector electrically connecting at least two inner projections provided for a same extension part.

26. The gas discharge display apparatus manufacturing method of claim 25, wherein a plasma display panel is manufactured by arranging the bus lines so as to extend lengthwise in the first step, and arranging cells in rows and columns to form a matrix pattern in the second step.

27. The gas discharge display apparatus manufacturing method of claim 25, wherein, in the connector arranging step, a same bus line is provided with a plurality of connectors so as to electrically connect the at least two inner projections provided for the same bus line, thereby forming aperture array patterns, each having a plurality of apertures formed along a length of each bus line in the pair of display electrodes, aperture array patterns being formed in at least two rows extending widthwise from each extension part.

28. The gas discharge display apparatus manufacturing method of claim 25, wherein in the connector arranging step, each connector is a strip arranged in parallel with the bus lines.

29. The gas discharge display apparatus manufacturing method of claim 27, wherein in the first step, a plurality of connectors and a plurality of inner projections are arranged so that a size of the plurality of apertures provided for each bus line varies for each aperture array pattern.

30. The gas discharge display apparatus manufacturing method of claim 29, wherein in the first step, a plurality of connectors and a plurality of inner projections are arranged so that the size of the plurality of apertures provided for each bus line becomes larger for array patterns further away from a minimum gap between the pair of display electrodes.

31. The gas discharge display apparatus manufacturing method of claim 27, wherein in the first step, a plurality of connectors and a plurality of inner projections are arranged so that each of the aperture array patterns provided for a same bus line has a different pitch.

32. The gas discharge display apparatus manufacturing method of claim 25, wherein in the first step, a plurality of connectors and a plurality of inner projections are arranged so that aperture array patterns for a same bus line further from the minimum gap between the pair of display electrodes have a narrower pitch.

33. The gas discharge display apparatus manufacturing method of claim 25, wherein in the first step, a gap between the pair of display electrodes is set so that ends of the at least two inner projections provided for each of the two bus lines are electrically connected by a connector, and a gap between the connectors provided for the bus lines is the minimum gap between the pair of display electrodes.

34. The gas discharge display apparatus manufacturing method of claim 26, wherein in the first step one or more outer projections are arranged parallel with a matrix column so as to protrude from at least one of the two bus lines on a side facing away from the other bus line.

35. The gas discharge display apparatus manufacturing method of claim 25, wherein in the first step, the bus lines are manufactured from metal, and in the projection arranging step, the projections are manufactured from a transparent electrode material.

36. The gas discharge display apparatus manufacturing method of claim 25, wherein a layer forming step is interposed between the first step and the second step, the layer forming step forming a layer on the surface of the first substrate so as to cover the at least one pair of display electrodes, an area of the layer corresponding to a minimum gap between a pair of display electrodes being manufactured from magnesium oxide, and a remaining area of the layer being manufactured from a material that has a lower electron emission yield than magnesium oxide.

37. The gas discharge display apparatus manufacturing method of claim 26, wherein in the layer forming step, the material with the lower electron emission yield is aluminum.

38. The gas discharge display apparatus manufacturing method of claim 25, wherein in the first step, when a discharge gas pressure is P and a discharge gap d, and a relation between product Pd and discharge firing voltage is shown by a Paschen curve, a minimum gap between the pair of display electrodes corresponds to a gap at a minimum discharge firing voltage or a vicinity thereof.

39. The gas discharge display apparatus manufacturing method of claim 25, wherein the first step includes a black layer arranging step of arranging, between the at least one pair of display electrodes and the first substrate on which the at least one pair of display electrodes are formed, a black layer for forming a black matrix that corresponds to a pattern formed by the at least one pair of display electrodes.

40. The gas discharge display apparatus manufacturing method of claim 39, wherein in the black layer arranging step, the black layer for the black matrix is formed of a metal that includes one of a metal oxide and Ag.

41. A display apparatus comprising:

a first substrate with a plurality of display electrodes;

a first display electrode coupled to the first substrate;

a second display electrode coupled to the first substrate and substantially parallel with the first display electrode;

the first display electrode including an extension part that extend lengthwise and substantially parallel to the second display electrode, a plurality of inner projections electrically connected to the extension part, and protruding toward the second display electrode, and a plurality of connectors electrically connecting two or more inner projections.

42. The display apparatus of claim 41 wherein the display apparatus is a gas discharge display apparatus in which a plurality of cells filled with a discharge gas are arranged in a matrix configuration and the first and second display electrodes span a plurality of cells, the cells having a cell pitch and the plurality of inner projections being substantially evenly spaced a distance smaller than the cell pitch.

43. The display apparatus of claim 41 wherein the plurality of inner projections extend in the same direction and are electrically connected to the extension part at a first end, and connected to the connectors at a second end.

* * * * *